US008270649B2

(12) United States Patent
Semcken

(10) Patent No.: US 8,270,649 B2
(45) Date of Patent: Sep. 18, 2012

(54) TECHNOLOGY DELIVERY, POSITIONING AND SOUND MANAGEMENT SYSTEM AND METHOD FOR USE IN THE EAR CANAL

(75) Inventor: Kevin Semcken, Wheat Ridge, CO (US)

(73) Assignee: Able Planet Incorporated, Wheat Ridge, CO (US)

( * ) Notice: Subject to any disclaimer, the term of this patent is extended or adjusted under 35 U.S.C. 154(b) by 996 days.

(21) Appl. No.: 12/252,991

(22) Filed: Oct. 16, 2008

(65) Prior Publication Data

US 2009/0110223 A1 Apr. 30, 2009

Related U.S. Application Data

(60) Provisional application No. 60/982,712, filed on Oct. 25, 2007.

(51) Int. Cl.
*H04R 25/00* (2006.01)

(52) U.S. Cl. ..... 381/329; 381/322; 381/324; 381/328

(58) Field of Classification Search ..... 381/312, 381/322, 324, 328, 329
See application file for complete search history.

(56) References Cited

U.S. PATENT DOCUMENTS

| | | | | |
|---|---|---|---|---|
| 6,635,068 | B1 | 10/2003 | Dubrul et al. | |
| 7,306,565 | B2 * | 12/2007 | Fraden et al. | 600/549 |
| 7,362,875 | B2 | 4/2008 | Saxton et al. | |
| 2001/0043708 | A1 * | 11/2001 | Brimhall | 381/328 |
| 2003/0051939 | A1 * | 3/2003 | Werblud | 181/131 |
| 2007/0009128 | A1 * | 1/2007 | Mahoney et al. | 381/328 |

* cited by examiner

*Primary Examiner* — Matthew E Warren
(74) *Attorney, Agent, or Firm* — Glenn H. Lenzen; Husch Blackwell LLP

(57) ABSTRACT

An in-the-ear technology delivery, positioning and sound management system comprises a body portion that provides support for a conformable fitting element adapted to be positioned in the user's ear canal and which is structured and arranged to anchor sound management technologies and medical instrumentalities at selected positions in the canal for the delivery and control of sound or for the performance of medical procedures therein. In an embodiment, a sound tube is provided which is adapted to deliver sound in close proximity to the ear drum and a method for selectively fitting the system in accordance with the wearer's personal comfort level is provided. In another embodiment, an apparatus and a method for a fitting pressure to be automatically applied along the device or aided by a fitting element that will facilitate placement and a secure fit in the ear canal is presented. A coating element comprising materials selected to manage, acoustically alter, or occlude sound properties and sound at selected depths within the ear canal is disclosed.

40 Claims, 16 Drawing Sheets

TECHNOLOGY DELIVERY, POSITIONING AND SOUND MANAGEMENT SYSTEM AND METHOD FOR USE IN THE EAR CANAL

CROSS REFERENCE TO RELATED APPLICATIONS

This application claims the benefit of U.S. Provisional Application No. 60/982,712 filed Oct. 25, 2007, which is incorporated herein by reference in its entirety as if fully set forth herein.

FIELD OF THE INVENTION

The present invention relates to devices which may be inserted into the ear passage for hearing enhancement, sound isolation and noise suppression, medical applications and for listening to audio and music transmissions. More particularly, the present invention relates to a technology delivery, positioning and sound management system and method which will permit the wearer of a hearing aid, noise suppressing ear plugs, earphones, cellular telephone handsets or headsets and accessories, and other such devices intended to deliver sound directly into the ear canal to selectively fit such devices into the unique configuration of the wearer's ear passage or canal.

BACKGROUND OF THE INVENTION

Recent advances in sound transmission technology have lead to the development of new and improved hearing aids, head sets, musical ear buds, sound isolation earphones, telephone hand sets and other devices designed specifically to transmit sound to the human ear. Certain devices such as telephone hand sets and head sets are designed to fit over the outer ear and are held in place either by hand or by means of a head band or ear hook, which frees up the hands for note taking or other activities which may be performed simultaneously while receiving information via the hand set or head set.

Other devices such as medical devices including but not limited to catheters, microsurgical tools, drug delivery devices and hearing aids, musical ear buds, ear plugs and both wired and wireless cellular telephone and other telecommunication accessories are pressed into the outer ear partially penetrating the ear canal and may be employed in performing medical procedures, drug deliveries and as straightforward sound transmitting systems. Hearing aids, on the other hand, provide a dual function by not only transmitting sound to the ear drum, but also by increasing sound isolation for hearing-impaired individuals and by selectively suppressing certain sound frequencies and/or modulating the amplitude of background or so-called "white noise". Ear plugs and hearing protection headsets, by contrast, are normally worn by individuals working in environments such as airports, factories, construction sites or around noisy machinery such as earth moving and farming equipment, mowing equipment, automobile racing stadiums and so forth where prolonged exposure to continuous elevated noise levels or to sudden explosive-like noises would be permanently damaging to hearing. Such devices may be referred to collectively as "in-the-ear devices" or "in-the-canal devices" (which terms will be used interchangeably herein) as opposed to "ear covering devices", such as the head sets described above.

As anyone who has used an in-the-ear device knows, a common problem associated with their use is proper fit in the outer portion of the ear canal. Manufacturers of these devices typically configure them to fit the average ear canal dimension, to the extent that that dimension can be determined, or, alternatively, may offer several different sizes—small, medium and large. Currently, in-the-ear devices are offered with several types of ear sleeves adapted for insertion into the ear canal. Typically, each sleeve includes one to three flanges or fins of progressively decreasing diameter, and one known device has five such flanges or fins. All of these devices are inserted no more than ¼ inch into the ear. The outermost flange is too large to be inserted into the ear, and the second and third flanges are too small in diameter to make full contact with the ear canal wall. However, this approach, at best, provides the user with an imprecise and uncomfortable fit, and, of greater significance, reduces the performance and effectiveness of the particular device, regardless of its intended function, be it transmission, enhancement, suppression or a combination of the foregoing, because the size of the flanges or fins cannot be increased to make full contact with the walls of the ear canal to occlude sound and cannot be lengthened due to the overall space limitations in the ear canal. This can be particularly troublesome and potentially even dangerous, as in the case of communication devices which find application in the military, police, fire fighting, motor car racing and emergency services fields where clarity and precision of communication is critical, and where the devices must frequently be worn for extended periods of time, often under harsh conditions.

Sound emitting devices with expanding earpieces are known in the art. One such device is disclosed in U.S. Patent Application Publication No. US 2007/0116319 A1 published by Hagberg, May 24, 2007. The Hagberg device includes an expandable earpiece which fits inside the inner ear canal and a compressible element filled with fluid that is connected to the expandable portion. The user of the device may selectively adjust the fit by controlling the amount of compression in the compressible element via controlling the fluid transfer between the two elements. However, this apparatus does not provide the desired features for controlling noise suppression and/or cancellation, sound quality enhancement, and so forth. Moreover, it does not allow contraction from the preset expansion for easy removal.

U.S. Pat. No. 7,362,875 issued Apr. 22, 2008 to Saxton et al., discloses a self-expanding hearing device adapted for use in the ear canal which requires that the user compress a frame supporting a membrane prior to insertion of the device into the ear. Upon release of the compression, the frame expands into the ear canal, thereby lodging the apparatus in place. However, this system does not permit selective adjustment of the fit, nor does it provide any sound management capability, which is required under many of the aforementioned conditions of use. It also does not allow for contraction from the preset expansion for easy removal.

In view of the foregoing, it can be seen that a need exists for a technology delivery, positioning and sound management system for use with in-the-canal devices which will provide a user with an easily adjustable fitting mechanism that will permit the user to not only adjust the pressure of the fitting elements according to his or her personal comfort needs, but also to permit the user to adjust the depth of insertion of the apparatus in the ear canal so as to position sound management technologies closer to the ear drum.

SUMMARY OF THE INVENTION

The technology delivery, positioning and sound management system of the present invention overcomes these and other problems not solved by prior art systems by providing a new and novel approach to tailoring the fit of in-the-canal devices to the individual wearer's particular ear canal dimensions. More particularly, the present invention provides a simple and easy to adjust mechanism whereby the wearer of an in-the-canal device may selectively adjust the size of the portion of the device which is positioned in the ear canal and the depth of insertion into the ear canal, not only to attain the desired level of wearing comfort, but also to maximize the efficiency and performance of the technology contained in the device. The user may thus optimize his or her wearing comfort level, but also by adjusting the snugness of the fit within the ear canal, the wearer may selectively increase or decrease the amount of background noise suppression in proportion to the individual's level of hearing impairment so as to maximize the effectiveness of the in-the-ear device. Moreover, audiological evaluations have demonstrated that, by inserting an in-the-ear device at least ¼ inch into the ear canal, sound quality is enhanced significantly, and that a device insertion depth of approximately ½ inch enhances sound quality by a factor of two (2). This finding is consistent with the "inverse square law" which holds that for each halving of the distance between the end of the sound emitting device, by way of example, a sound tube, and the ear drum in a closed capacity (the ear canal), the sound pressure doubles.

In particular and by way of example only and not by limitation, according to an embodiment, a technology delivery, positioning and sound management system is provided which includes a support element adapted to be inserted into the ear canal and having an elongate body portion for supporting at least one technology module; the technology modules including by way of example but not limited to, a medical device such as a catheter, a microsurgical tool and a drug delivery device; a sound tube, a receiver, a speaker, a microphone, a bone conductivity device, a sound volume balance control device, and a noise cancelling device; and a selectively expandable conformable fitting element which may be conformably fitted to the inner ear canal.

In another embodiment, the conformable fitting element automatically deforms to conform with the inner ear canal in response to being inserted therein.

In yet another embodiment the system includes means for selectively moving the conformable fitting element from a radially compressed position to a radially expanded position or from a radially expanded position to a radially compressed position.

In still another embodiment, there is provided a method for selectively positioning a technology system within an ear canal, the method comprising: selecting a technology system comprising at least one technology module, a support element structured and arranged for insertion into the ear canal and including an elongate body portion for supporting the at least one technology module, and a conformable fitting element adapted for comfortably fitting into the ear canal; moving the conformable fitting element to a radially compressed state, positioning the technology element at a selected location within the ear canal, moving the conformable fitting element to a radially expanded state such that the conformable fitting element is fitted to the configuration of the ear canal; releasing the technology system by moving the conformable fitting element to the radially compressed state; and removing the technology system from the ear canal.

Further objects, features, and advantages of the invention will be apparent from the following detailed description when taken in conjunction with the accompanying drawings.

DESCRIPTION OF THE INVENTION

Before proceeding with the detailed description, it should be noted that the present teaching is by way of example, not by limitation. The concepts herein are not limited to use or application with one specific type of in-the ear-canal device. Thus, although the instrumentalities described herein are for the convenience of explanation, shown and described with respect to exemplary embodiments, the principles herein may be equally applied in other types of in-the-canal devices.

Figure 1:
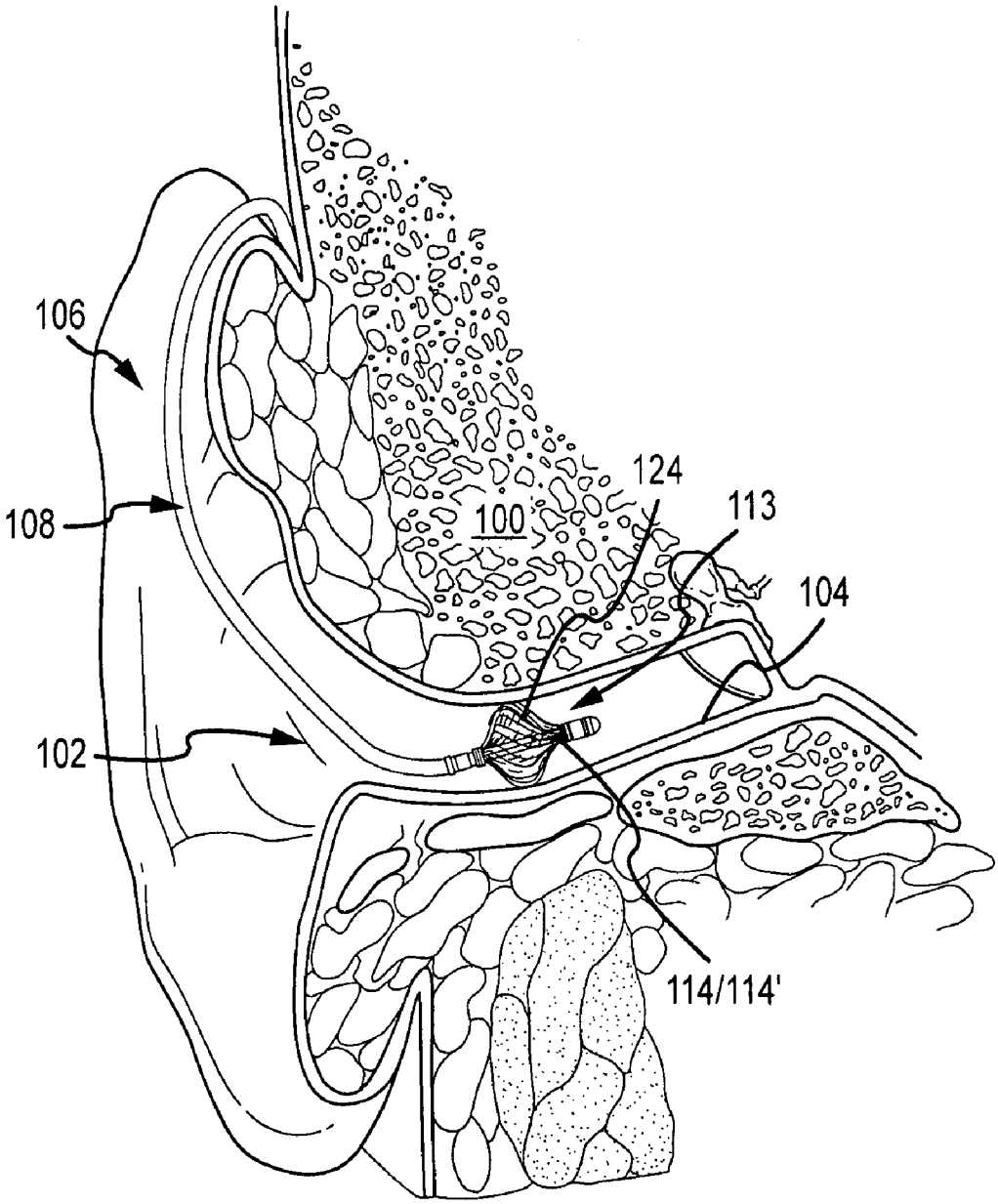
FIG. 1 is a cross sectional view of a human ear having an in-the-ear device disposed therein.

Turning now to FIG. 1, a human ear 100 is illustrated in cross section having an in-the-ear device in the form of a technology delivery, positioning and sound management system 102 (which for purposes of simplicity will hereinafter be referred to as "the system") disposed in the outer ear passage or canal 104. By way of example and for purposes of illustration only, the system is shown as employed in conjunction with a hearing aid apparatus 106; however, it is to be understood that the present invention may be used in conjunction with other in-the-ear devices including but not limited to cellular telephone accessories and communication equipment, musical ear buds, wireless and tethered earphones, ear plugs, and the like.

Figure 12:
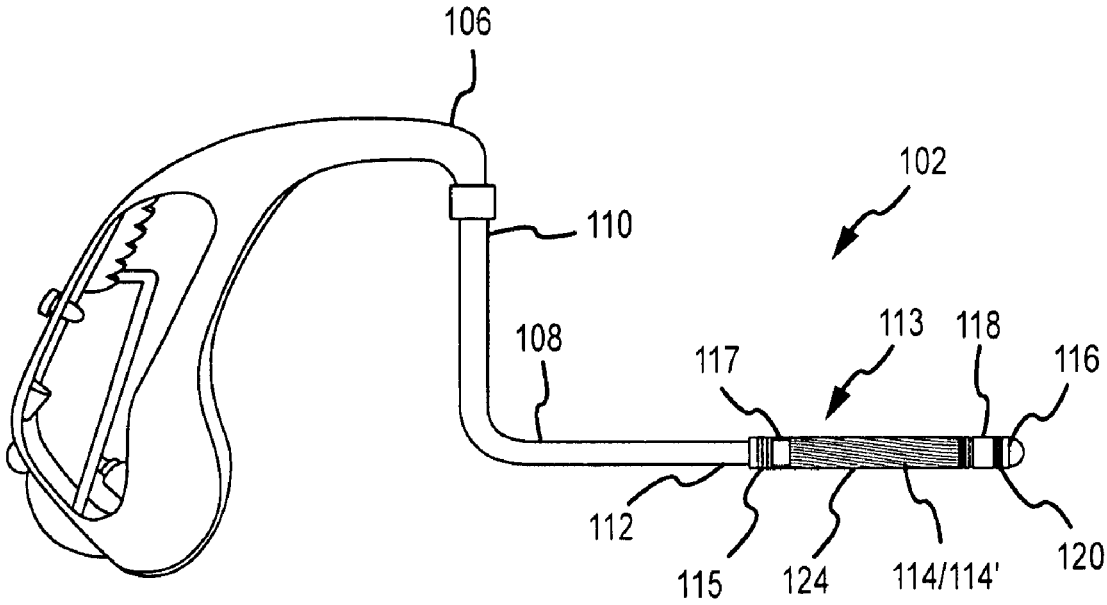
FIGS. 12 and 13 are side elevational views of an in-the-ear device incorporating a ratchet mechanism for selectively positioning the conformable fitting device in the compressed state and the expanded state respectively.
Figure 13:
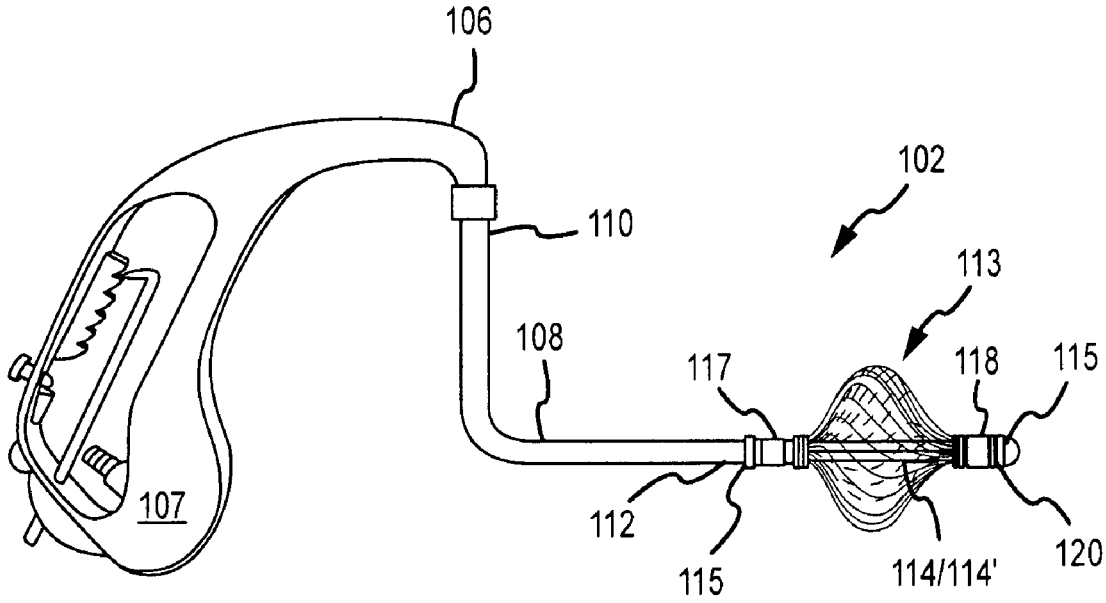

Referring momentarily to FIGS. 12 and 13, the hearing aid 106 includes a hearing aid housing 107 which is normally worn behind the ear for cosmetic purposes and which may contain by way of example and not limited to: sound enhancing circuitry, sound volume and balance controls, a power source (not shown), and so forth. The hearing aid includes a tubular member or sound tube 108 having a proximal end 110 connected to the housing 107 and a distal end 112 which is connected to the system 102. The system includes a support element shown generally at 113, which is structured and arranged for insertion into the ear canal 104. The support element includes an elongate body portion 114 having a proximal end 115 and a distal end 116, the body portion being adapted to support preselected technology modules, by way of example and not limited to the sound tube 108 and other modules, modules 117, 118, and 120 for performing various sound management and/or medical functions. In the embodiments of FIGS. 1, 12 and 13, for purposes of illustration, the technology modules are shown supported on the body portion at various locations intermediate the proximal and distal ends 115 and 116, respectively. However, again, depending upon the intended application and the types of modules being deployed, a system designer may configure the location of each module differently according to its intended function and technology module space requirements. They may be located at the distal end of the body portion, the proximal end, both ends, or anywhere in between without departing from the scope of the present invention.

The selection of a module or a plurality of modules for inclusion in a particular system configuration and its position on the system body portion depends upon a number of factors, including, as discussed above, the types of functions required or desired for the specific application and the environment in which the system is intended to be used. For example, a technology module may be in the form of a sound tube, a receiver, a microphone, a speaker, a bone conductivity device, a digital signal processing device, a volume balance control apparatus, an acoustic calibration device, a noise cancelling device, a sound amplification system, a medical device, a noise or sound sampling apparatus, a feedback device or a combination of the foregoing. For medical applications, the system may include an anchoring element (not shown) to support and secure a medical device for performing a procedure within the ear canal. Such devices may include a light source to enhance visibility within the canal, a catheter, a microsurgical tool, or an imaging device; although, it is to be understood that other medical instruments such as a drug delivery device may be employed in conjunction with the system, as well.

As shown in FIGS. 1, 12 and 13, the support element 113 comprises a solid cylindrical member or wire 114' of sufficient diameter and stiffness so as not to deform upon insertion into the ear canal. In another embodiment illustrated in FIGS. 3 and 4, a support element 122 is shown which is in the form of a tube structured and arranged to deliver audio signals to the ear canal. The support element includes an aperture 123 extending substantially longitudinally coaxially through the support element and is adapted to receive electrical connectors or wires extending from a power source (not shown) to one or more technology modules which may be incorporated into the system configuration.

Figure 2:
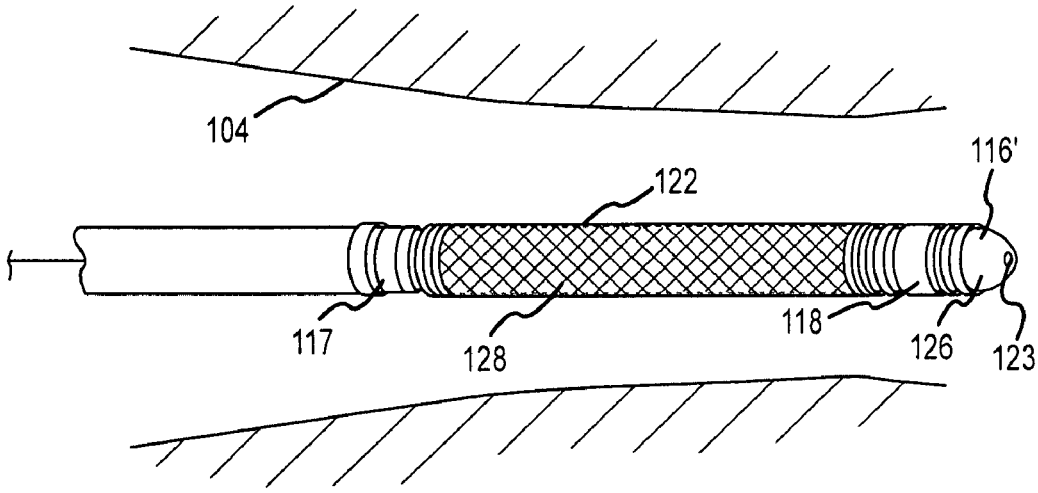
FIG. 2 is an enlarged side view of an in-the-ear device showing a conformable fitting device in a compressed state according to an embodiment of the present invention.
Figure 3:
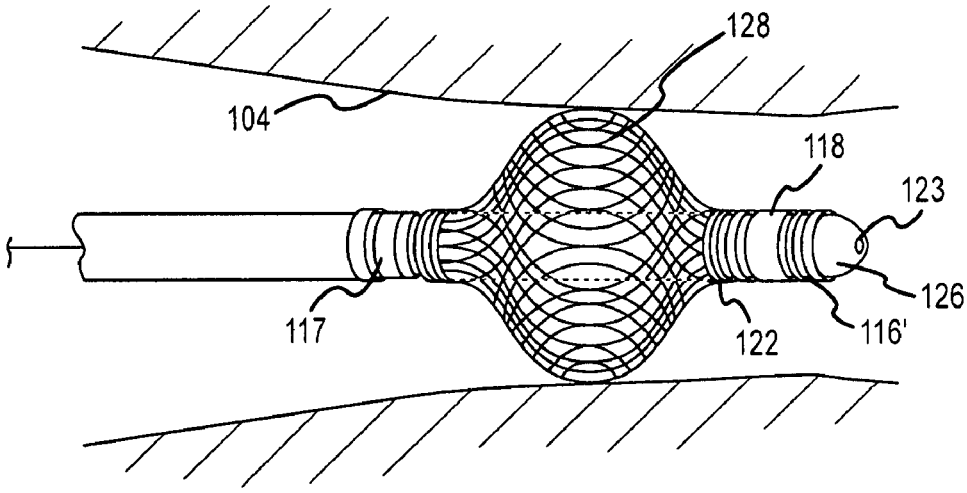
FIG. 3 is an enlarged side view of an in-the-ear device showing a conformable fitting element in an expanded state according to an embodiment.

Referring still to FIGS. 2 and 3, a conformable fitting member or element 124 is positioned on the support element 122 of system 102 and is deformable for insertion into and removal from the ear canal and adapted to be conformably fitted to the ear canal 104. The conformable fitting element may be adapted to automatically expand in response to insertion into the ear, or, alternatively, it may be inserted in an expanded configuration and automatically contract upon insertion into the ear. In the embodiment of FIGS. 2 and 3, the conformable fitting element may be formed of formed of an annular wire mesh or braided material as shown; although, as will be discussed in greater detail below, other materials and configurations may also be employed without departing from the scope of the present invention. The fitting element 124 is positioned circumferentially around the tube 124 and extends longitudinally along and rests upon its outer surface in a radially compressed or unextended position. An acoustic cap or tip 126 is secured to the distal end 116' of the tube and may include a sound enhancing device such as a speaker (not shown), depending upon the intended application of the system, the tip being adapted to facilitate insertion of the system into the ear canal 104.

Figure 15:
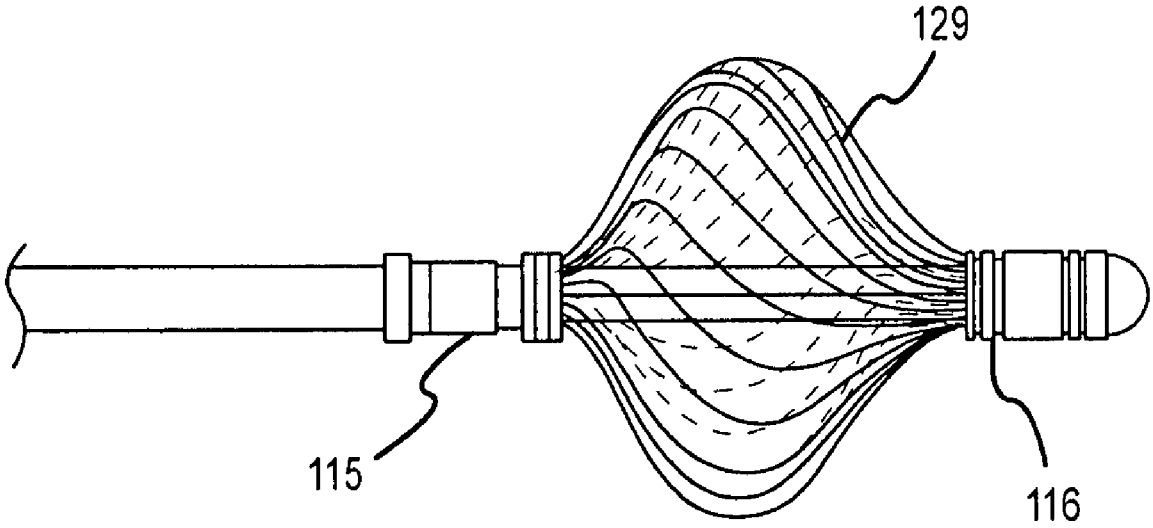
FIG. 15 is a side elevational views of an in-the-ear device depicting the conformable fitting element having thin strands of expandable polymer material arranged to acoustically alter sound properties.

A coating layer or film 128 of a suitable material such as rubber or a deformable polymer or plastic may also be applied to the fitting element as needed for purposes of comfort and sanitation; however, depending upon the choice of material, the film layer, when conformably fitted to the ear canal, may be structured and arranged to acoustically alter the properties of the sound being delivered by the system. By way of example, if the film or coating material is porous material, ambient sounds can pass directly to the ear drum. Alternatively, the porous material may be in the form of strands 129 of expandable polymer material which may be structured and arranged to also acoustically alter the sound properties, as is shown in greater detail in FIG. 15. On the other hand, if a film or coating material is applied which is sound-impermeable material, when conformably fitted to the ear canal, the material will prevent ambient sound from reaching the ear drum. By selectively adjusting the fit and the depth of insertion, it may be understood that a user of the system may thus acoustically alter the properties of the sound impinging upon the ear drum. Audologial evalutations have demonstrated that sound quality is enhanced significantly at insertion depths of ¼ inch into the ear canal, and that at an insertion depth of approximately ½ inch, sound quality is enhanced by a factor of two (2), consistent with the inverse square law discussed above.

Figure 4:
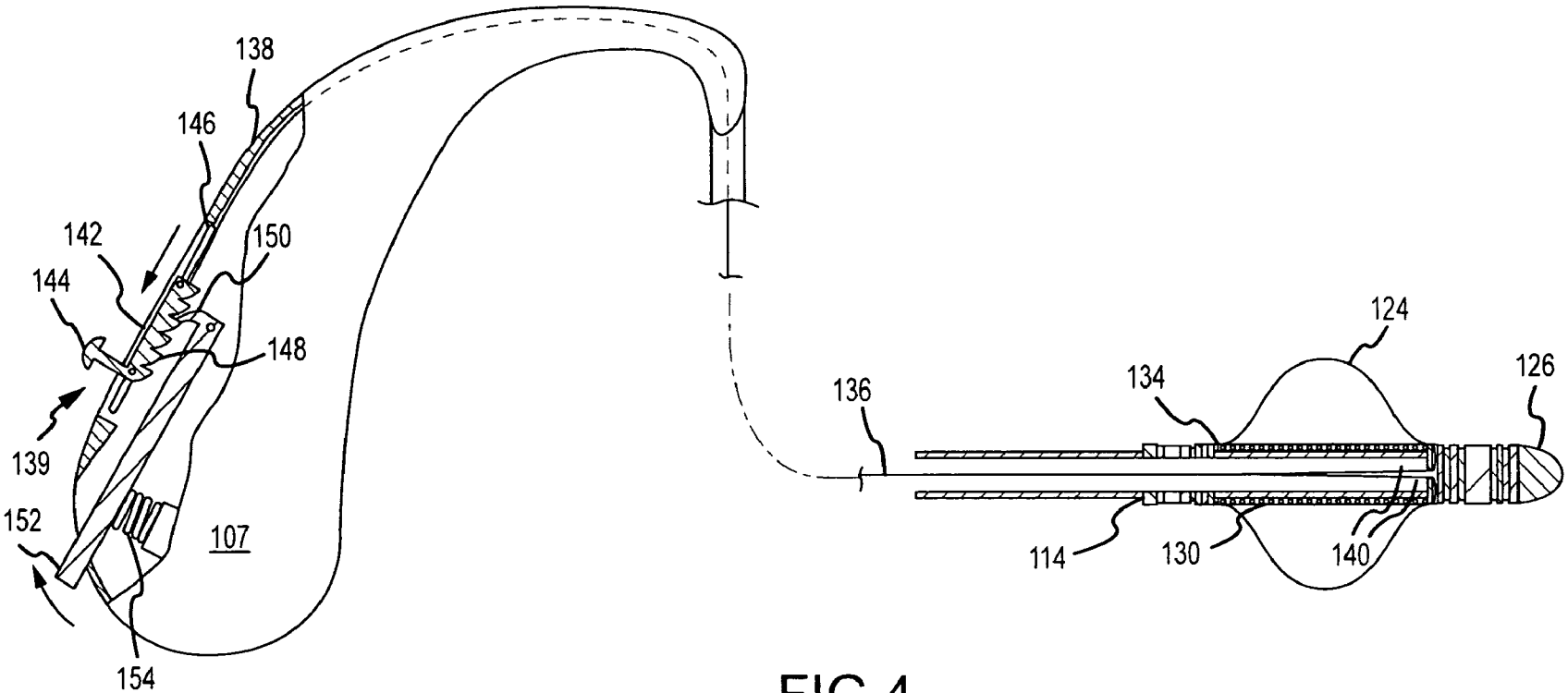
FIG. 4 is an enlarged partial sectional view of a hearing-aid according to an embodiment.

Referring now to FIG. 4, an apparatus for selectively moving or adjusting the conformable fitting element is illustrated in greater detail. To attain a desired comfort level and snugness of fit, a wearer of the system of the instant invention incrementally moves the fitting element from a radially compressed position (FIG. 2) to any radially expanded position wherein the conformable fitting element has a radial dimension which is equal to or greater than its radial dimension in the radially compressed position. In the embodiment of FIG. 4, the moving apparatus includes spring 130 disposed adjacent the acoustical tip 132 over and extending circumferentially along the elongate body portion 114 which applies pressure against the tip and an opposite end 134 of the conformable fitting element 124, thereby maintaining the element in an undeployed or radially compressed position along the body. Selective adjustment of the fitting element is achieved by means of a wire 136 having a first end 138 connected to an adjusting mechanism 139 positioned in the hearing aid housing 107 and at least two second ends 140 which extend from the end of the body portion and back down its outer surface along the spring. The second ends 140 are secured to the end of the spring at the end of the conformable fitting member. The first end of the wire is connected to a ratchet 142 having adjusting arm 144 affixed thereto for manipulation by the wearer of the device. The ratchet is slideably positioned in a channel 146 which may be formed in the housing 107. Ratchet teeth 148 releasably engage pawl 150 formed in the end of release lever 152, which is urged into engagement with the ratchet by spring 154, as shown. The wearer may selectively adjust the depth of insertion and the fit of the device in his or her ear canal by depressing the release lever 152 to release the ratchet, sliding the ratchet in the channel in one direction or the other to move the fitting member radially outwardly or inwardly with respect to the tube to attain the desired fit and pressure, and thereafter releasing the release lever to reengage the ratchet.

Figure 5:
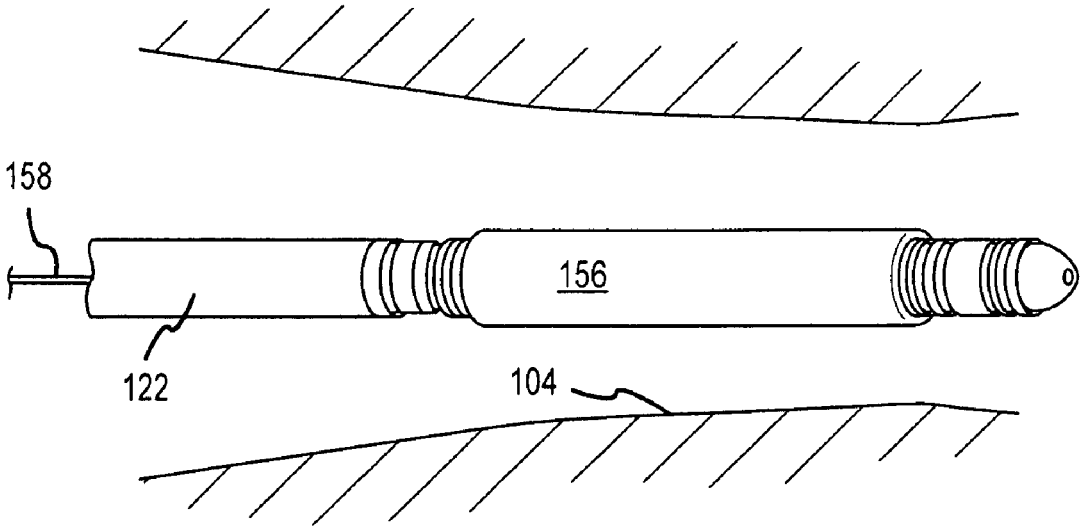
FIGS. 5 and 6 are side elevational views of yet another embodiment of the present invention in unexpanded and expanded modes, respectively.
Figure 6:
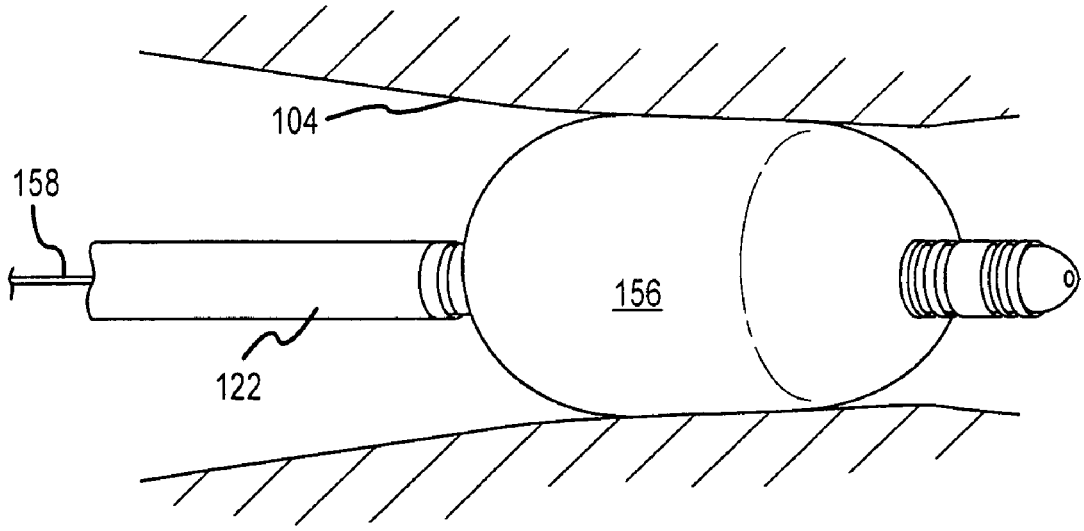

FIGS. 5 and 6 illustrate another embodiment of the present invention wherein the conformable fitting member comprises a balloon 156 which may be selectively inflated or deflated by the wearer of an in-the-ear device, as hereinabove described. Air is directed to or from the balloon via a thin tube 158 extending substantially coaxially within the tubular member 122 from a source of pressurized air (not shown) to the balloon. The amount of air supplied to the balloon may be controlled by the wearer via suitable air control means to either increase or decrease the pressure against the ear passage 104 to attain the desired level of comfort and/or noise suppression at any depth of insertion. The choice of material for the balloon may be of a deformable polymer or plastic, as discussed above, which may also be porous, semi-porous or acoustically impermeable, thereby permitting the wear to acoustically alter the properties of the sound heard by the wearer.

Figure 7:
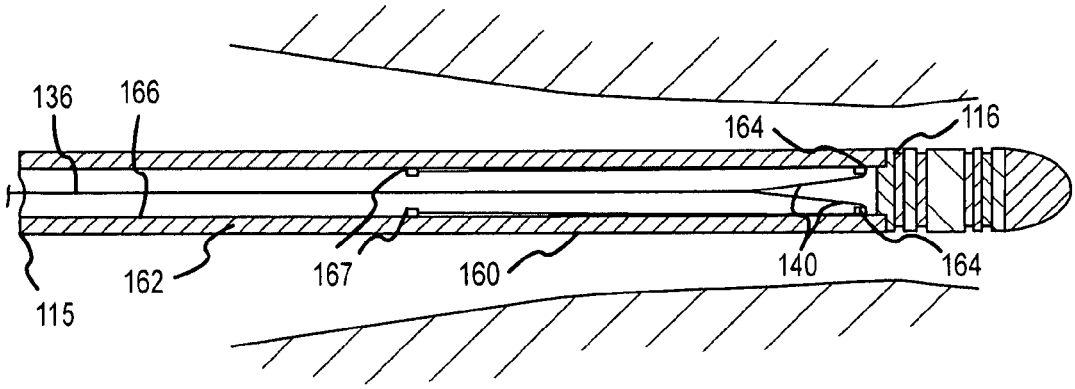
FIGS. 7 and 8 are cross sectional views of still another embodiment of the present invention in expanded and unexpanded modes, respectively.
Figure 8:
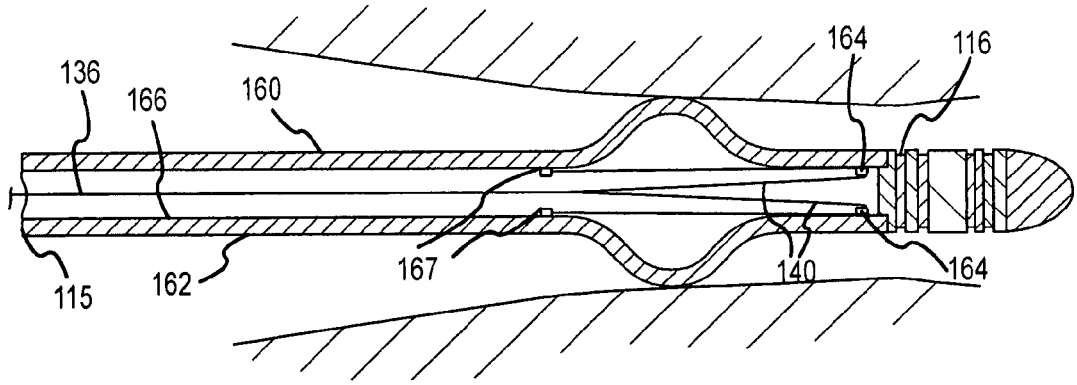
Figure 14:
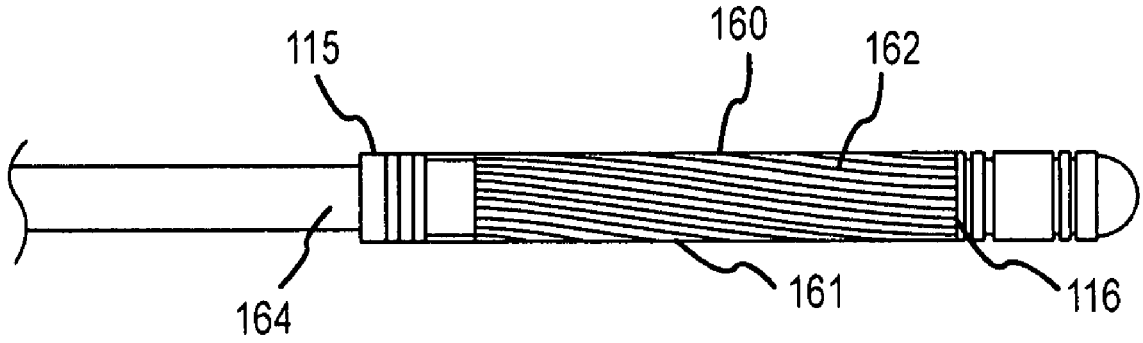
FIG. 14 is a side elevational view of an in-the-ear device having a conformable fitting element comprising axially positioned structural members in the compressed state.

Yet another embodiment of the system of the present invention is depicted in FIGS. 7, 8 and 14. In this embodiment, the support element is in the form of a tube 160 having a plurality of longitudinal slots or openings 161 formed therein. The slots are of such size and number so as to form axially-positioned structural members 162 shown in cross-section in FIGS. 7 and 8 and which may be manufactured by means of laser cutting, electron beam processing or other similar small-scale manufacturing processes in suitable materials such as Nitinol. The slots and structural members are spaced so as to permit controlled deformation of the tube wall radially outwardly in response to compressive forces applied thereto by wire 136. As hereinabove described, the wire is connected at one end to an adjusting mechanism, by way of example, the mechanism 139 illustrated in FIG. 4. The distal end of the wire is split into at least two ends 140 which are extended over mandrels or pulleys positioned inside tubular member 164. The wire ends 140 then extend down into the interior of the tube and are secured to the inner wall 166 thereof at preselected locations 167 near the end of the longitudinal slots. When the wearer pulls on the wire 136, the force exerted via the at least two ends 140 moves the distal end 116 of the body portion relative to the proximal end 115 which effectively collapses the wall structure of the tube compressing the conformable fitting element and thereby controllably urging it into direct circumferential contact with the ear canal 104. When the adjusting mechanism is released, the inherent compressive forces in the resilient material of the tube force it back into the undeployed position, thereby permitting removal of the entire system from the ear canal.

Figure 9:
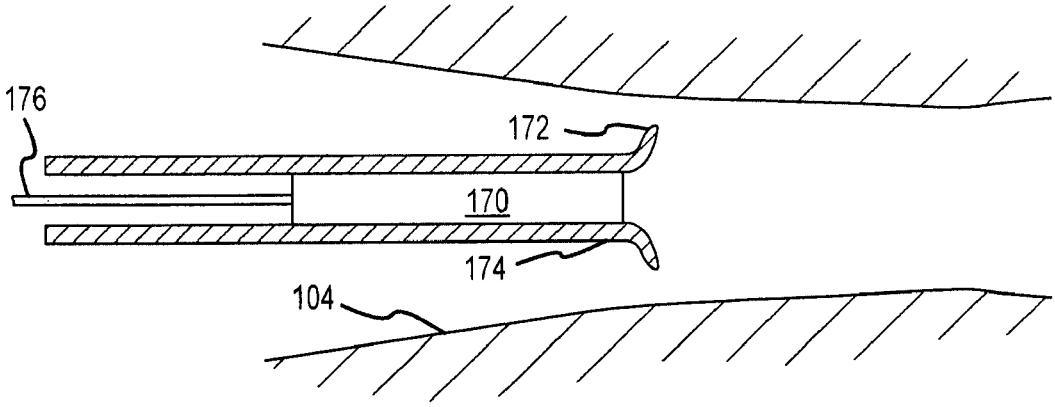
FIGS. 9 and 10 are cross sectional views of another embodiment of the present invention prior to deployment and after deployment of a conformable fitting element, respectively.
Figure 10:
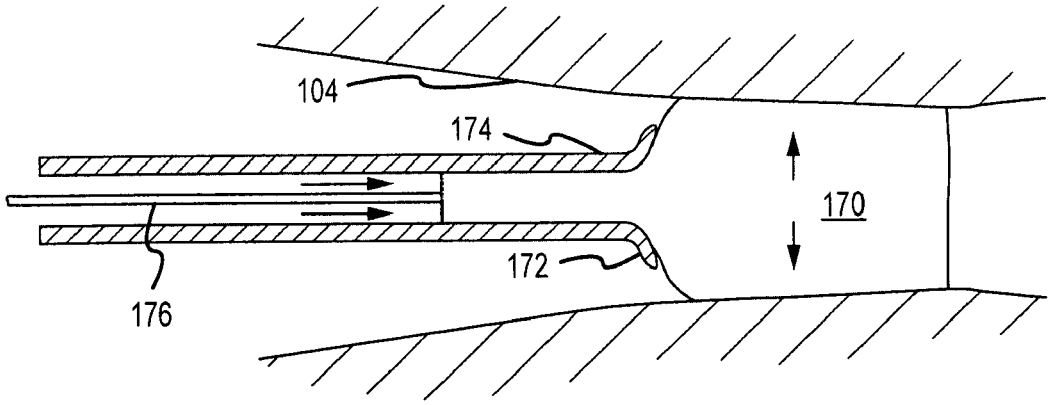

FIGS. 9 and 10 illustrate another embodiment of the present invention in which a plug member 170 formed of compliant foam material of suitable composition is employed as a conformable fitting element to fit the system in the ear passage 104. In this embodiment, the edge 172 of distal end 174 of the tube is flared to slideably force the foam plug out of the end of the tube in response to adjustments made by the wearer via wire 176. As the foam plug is forced out of the tube, it expands to fill the ear canal 104 to achieve the degree of fitting pressure and/or sound suppression desired by the wearer. Generally speaking, the greater the amount of foam forced out of the end of the tube, the greater will be the amount of pressure exerted against the ear passage and the greater the level of sound suppression at the selected depth of insertion. The foam may then be retracted back into the tube body for removal of the device from the ear canal.

Figure 11:
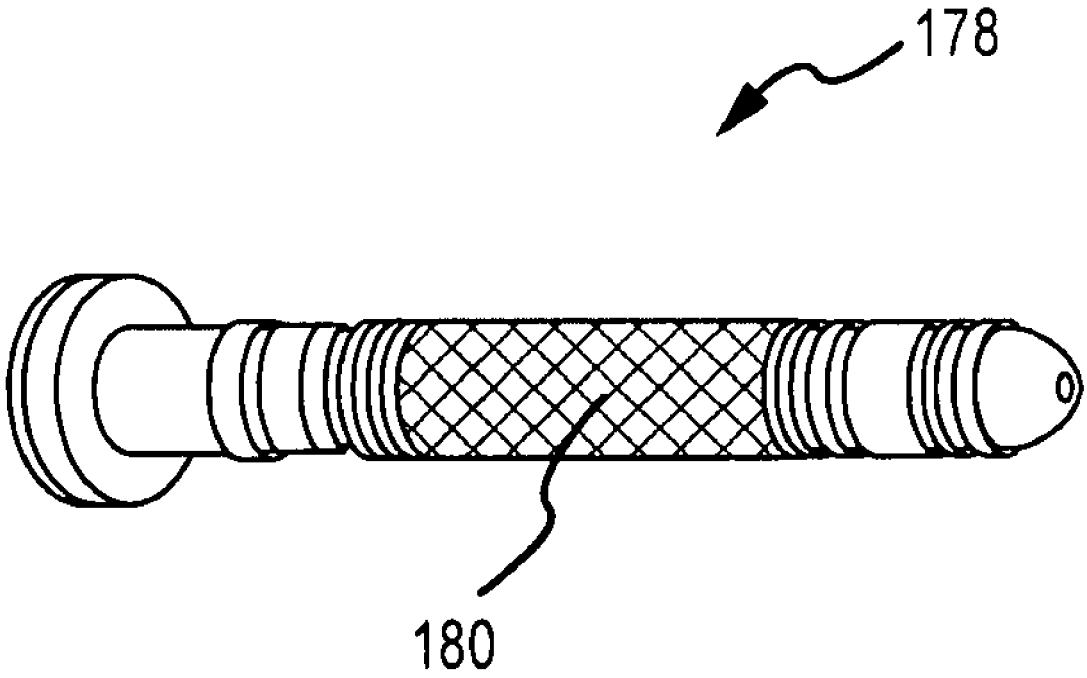
FIG. 11 is a side elevational view of an ear plug in accordance with an embodiment.

FIG. 11 illustrates a simple ear plug 178 constructed in accordance with the present invention for providing hearing protection from continuous high levels of background noise or from intense explosive types of noise. In the illustration shown, the conformable fitting member is in the form of radially expandable wire mesh 180, as hereinabove described which may be selectively expanded by a wearer to attain the desired level of fit comfort and sound suppression. It is to be understood that any of the foregoing embodiments may also be incorporated into the ear plug to attain the same level of adjustable fit without departing form the scope of the present invention.

Figure 16:
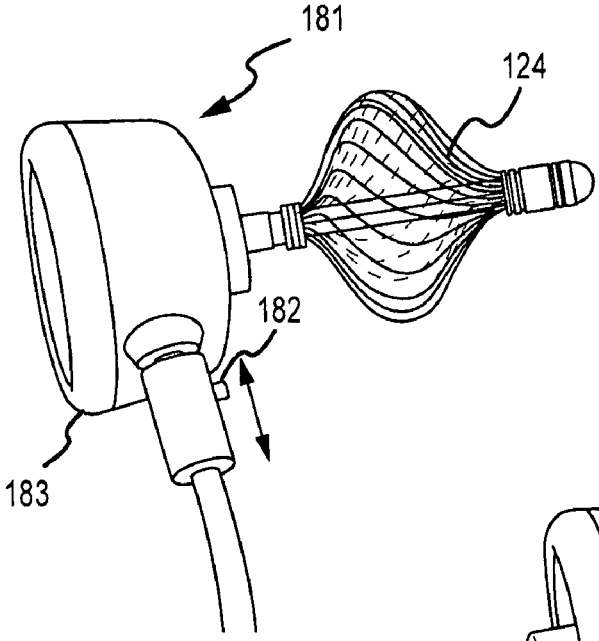
FIG. 16 is a perspective view of an in-the-ear device including a releasable slide mechanism for selectively moving a conformable fitting element between a radially compressed state to a radially expanded state.
Figure 17:
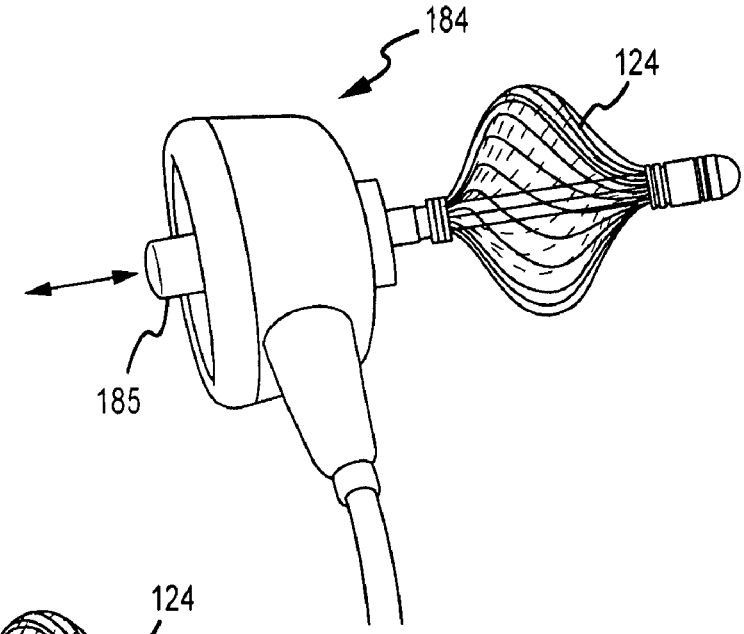
FIG. 17 is a perspective view of an in-the-ear device including a releasable button-actuated mechanism for selectively moving a conformable fitting element between a radially compressed state to a radially expanded state.
Figure 18:
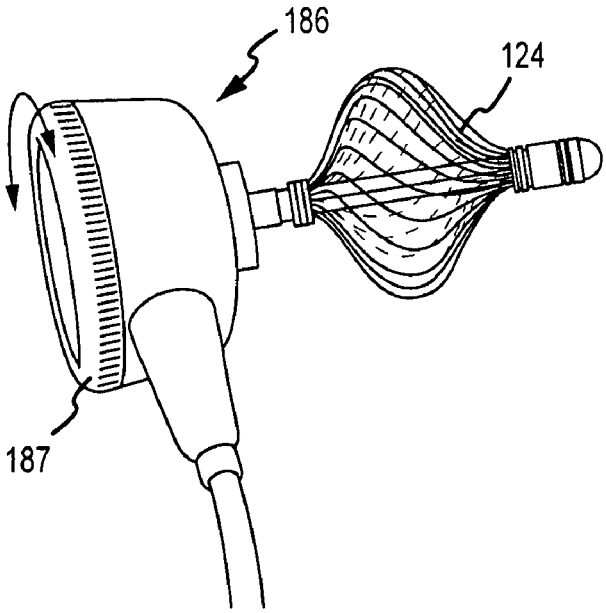
FIG. 18 is a perspective view of an in-the-ear device including a rotatable knob mechanism for selectively moving a conformable fitting element between a radially compressed state to a radially expanded state.

Referring now to FIGS. 16-18, alternate embodiments of the system of the present invention are depicted having various forms of apparatus for selectively moving or adjusting the conformable fitting element. FIG. 16 illustrates a system which employs a releasable slide mechanism 181 which is operatively connected to the conformable fitting member in a manner as hereinabove described. By depressing release element 182, a user may move a slide member 183 in the direction of the arrow, thereby moving the conformable fitting element from a radially compressed state to a radially expanded state to conformably fit the apparatus in the ear canal.

FIG. 17 illustrates yet another embodiment comprising a releasable button-actuated mechanism 184 in which a button 185 is either depressed or released in the direction of the arrow to move the conformable fitting element. FIG. 18 depicts still another embodiment in which the mechanism for deploying the conformable fitting element 124 is in the form of a variable rotating knob mechanism 186 which may be used by rotating knob 187 in the direction of the arrow to either engage or release the conformable fitting element 124 with the ear canal.

Figure 19:
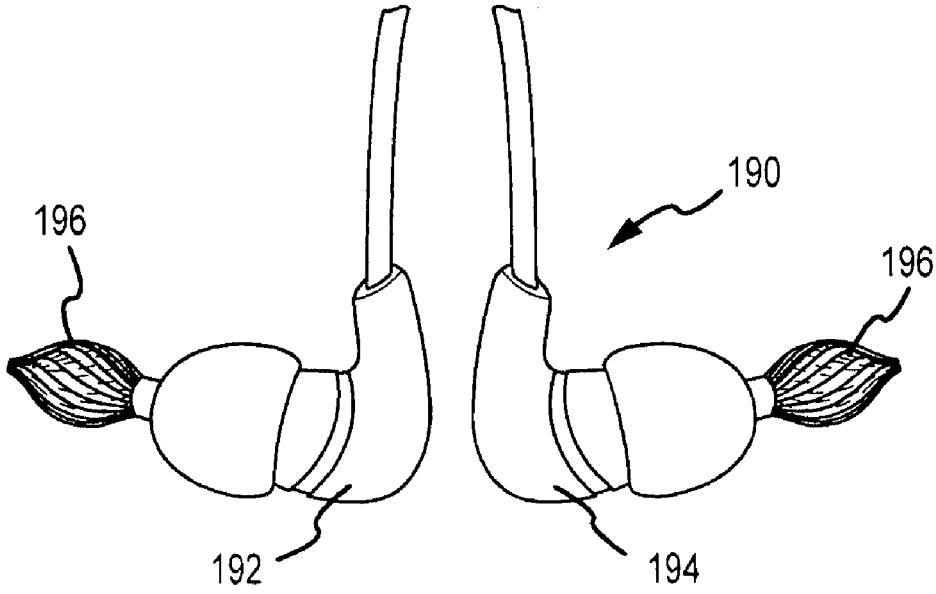
FIG. 19 is a perspective view of a set of sound isolation earphones in accordance with an embodiment.

Referring now to FIGS. 19-25, various acoustic devices constructed in accordance with the present invention are shown. FIG. 19 illustrates a pair of sound isolation earphones 190, the right and left earphone 192, 194 each having a conformable fitting element 196 constructed in accordance with the present invention affixed thereto and adapted to be removably inserted in the wearer's right and left ear canal, respectively.

Figure 20:
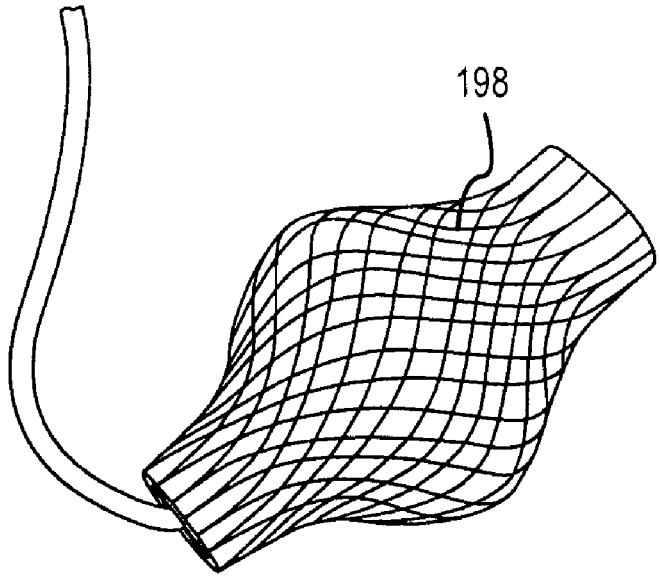
FIG. 20 is an enlarged perspective view of a conformable fitting element having a sound-impermeable material film layer disposed thereon.
Figure 21:
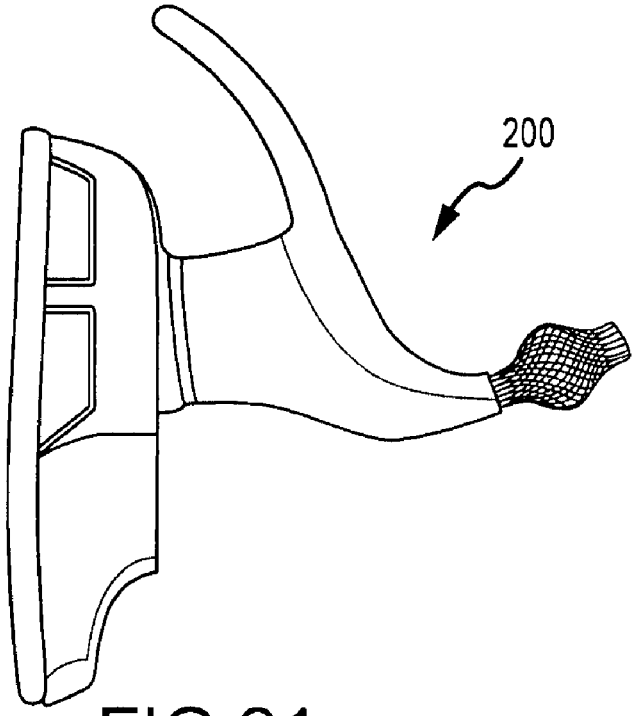
FIG. 21 is a side view of a wireless cellular communication device in accordance with an embodiment.
Figure 22:
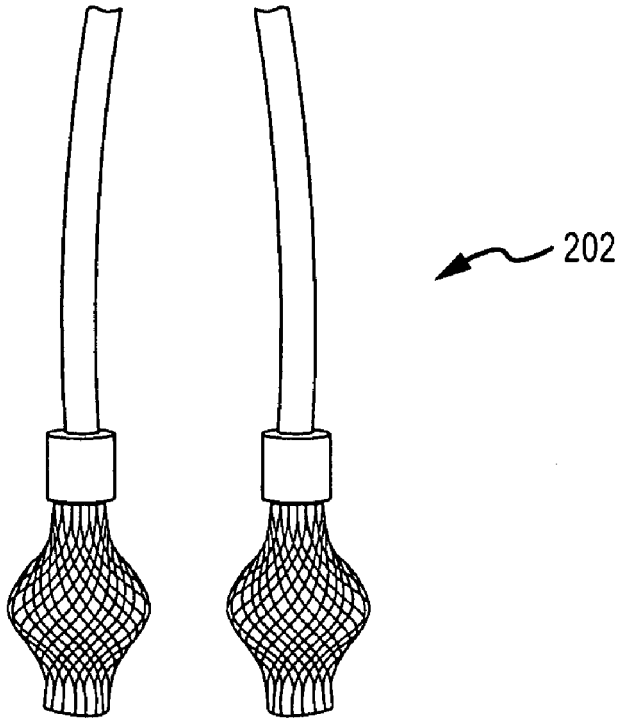
FIG. 22 is a side view of a pair of in-the-canal communication earphones adapted for use in extreme listening environments according to an embodiment.
Figure 23:
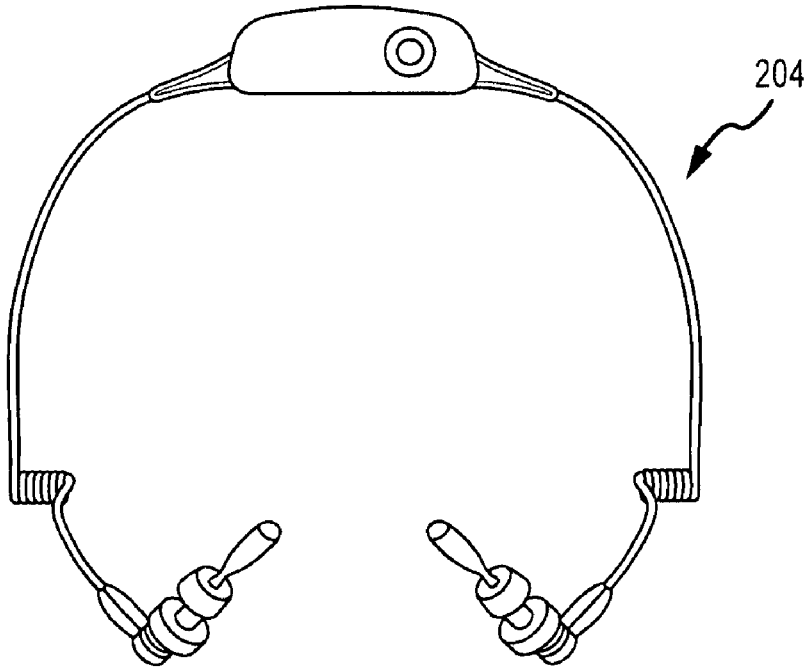
FIG. 23 is a perspective view of a wireless tethered earphone apparatus according to an embodiment.
Figure 24:
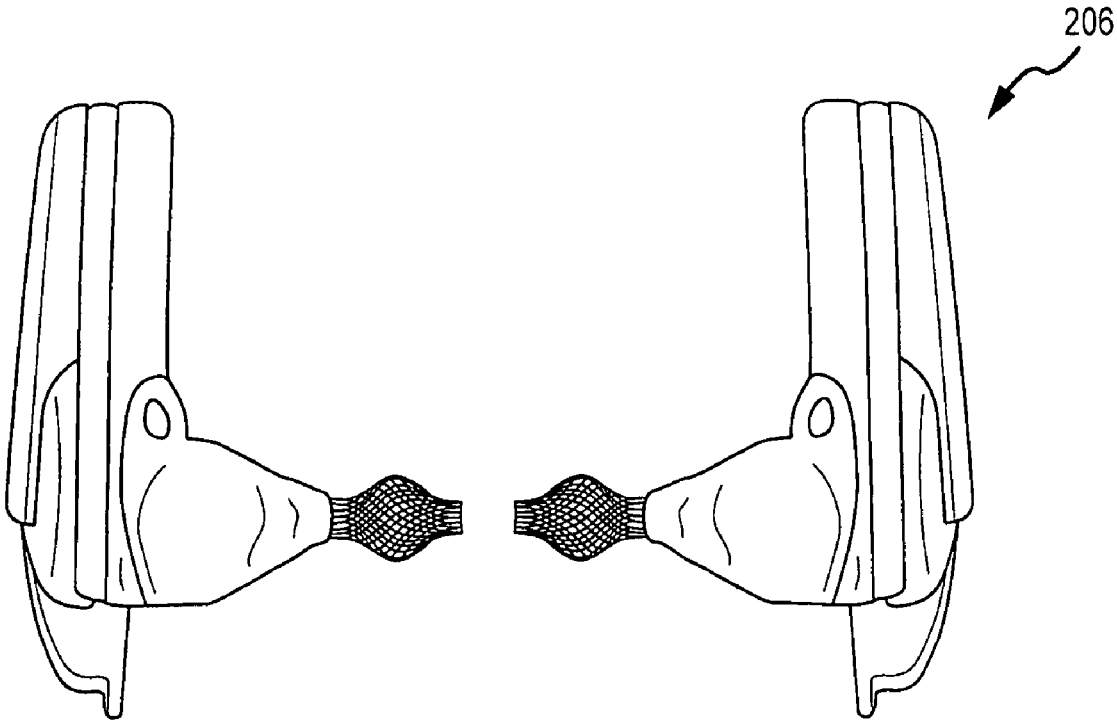
FIG. 24 is a perspective view of a pair of untethered wireless earphones in accordance with an embodiment.
Figure 25:
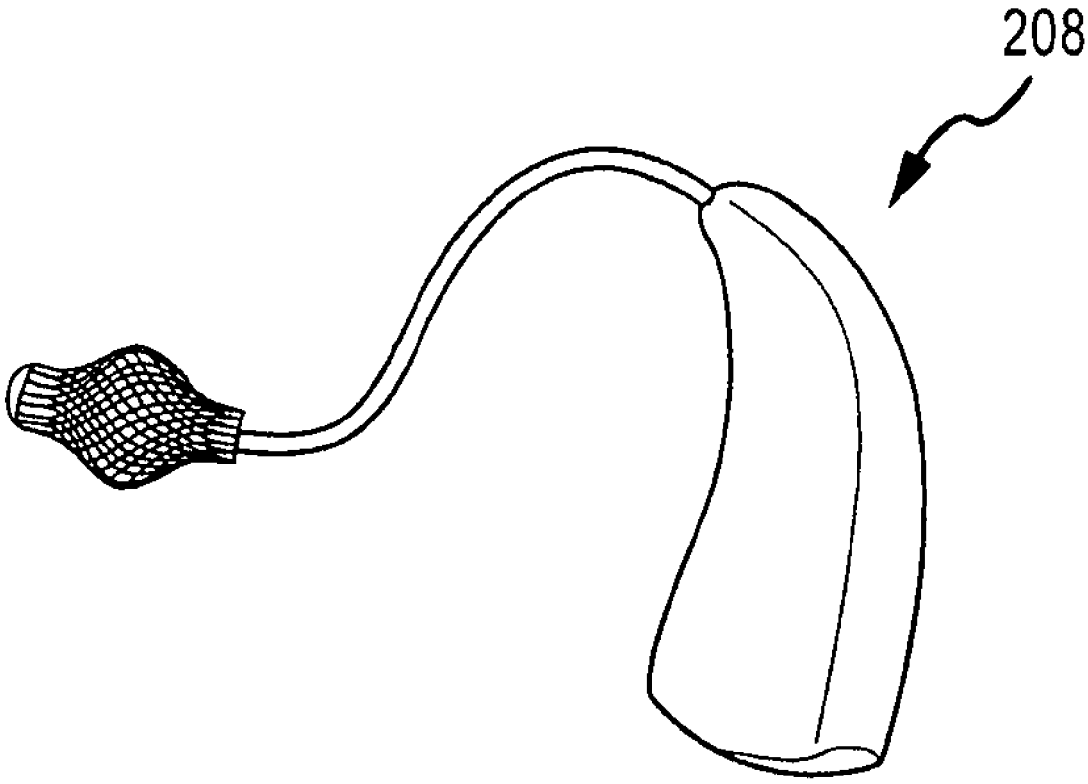
FIG. 25 is a perspective view of a hearing aid device in accordance with an embodiment.

FIG. 20 shows an enlarged view of a conformable fitting element 198 constructed in accordance with the present invention in a radially expanded position. FIG. 21 depicts a wireless cellular communication device 200, by way of example, a Bluetooth® device, incorporating the fitting element of FIG. 20. FIG. 22 depicts a pair of in-the-canal communication earphones 202 for use in extreme service environments equipped with the fitting element of FIG. 20, in accordance with an embodiment. FIGS. 23 and 24 show tethered and untethered wireless earphones 204, 206, each adapted with the fitting element of FIG. 20; and FIG. 25 illustrates a hearing aid apparatus also equipped with the conformable fitting device of the present invention.

In application, a wearer of any of the forgoing devices may conveniently position the technology delivery positioning, and sound management system of the present invention in his or her ear canal by:

selecting a technology system having the desired technology modules for the system configuration, a support element structured and arranged for insertion into the ear canal and including an elongate body member for supporting the selected technology modules, and a conformable fitting element which is deformable for insertion and removal into and from the ear canal;

positioning the conformable fitting element in a radially compressed state;

positioning the technology system at a selected location within the ear canal;

moving the conformable positioning element from the radially compressed state to a radially expanded state such that the conformable fitting element is selectively fitted to the configuration of the wearer's ear canal.

To remove the technology system from the ear canal, the wearer need simply move the conformable fitting element from the radially expanded state to a radially compressed state and remove the system from the ear canal.

Changes may be made in the above methods, systems and structures without departing from the scope thereof. It should thus be noted that the matter contained in the above description and/or shown in the accompanying drawings should be interpreted as illustrative and not in a limiting sense. The following claims are intended to cover all generic and specified features described herein, as well as all statements of the scope of the present method, system and structure, which, as a matter of language, might be said to fall therebetween.

What is claimed is:

1. A technology delivery, positioning and sound management system selectively positionable at any location in the ear canal comprising:

at least one technology module;

a support element structured and arranged for insertion into the ear canal, the support element including an elongate body portion for supporting the at least one technology module and having a proximal end and a distal end;

a conformable fitting element positioned on the support element, the conformable fitting element being deformable for insertion into and removal from the ear canal and adapted to be selectively conformably fitted to the ear canal, the conformable fitting element being selectively incrementally movable between a radially compressed position and a radially expanded position, the conformable fitting element having a radial dimension in any radially expanded position which is equal to or greater than its radial dimension in the radially compressed position; and moving means for selectively incrementally moving the conformable fitting element, the moving means comprising a ratchet.

2. The system of claim 1 wherein the at least one technology module includes a tubular member structured and arranged to deliver audio signals to the ear canal.

3. The system of claim 1 wherein the at least one technology module is positioned intermediate the proximal and distal ends of the body portion of the support element.

4. The system of claim 3 further including an aperture extending substantially longitudinally coaxially through the support element and adapted to receive electrical conductors for connection to the at least one technology module.

5. The system of claim 1 wherein the at least one technology module includes a receiver.

6. The system of claim 1 wherein the at least one technology module includes a speaker.

7. The system of claim 1 wherein the at least one technology module includes a microphone.

8. The system of claim 1 wherein the at least one technology module includes a bone conductivity device.

9. The system of claim 1 wherein the at least one technology module includes a digital signal processing device.

10. The system of claim 1 wherein the at least one technology module includes a sound volume balance control device.

11. The system of claim 10 wherein the sound volume balance control device includes an acoustic calibration device for selectively controlling sound volume between at least two output devices.

12. The system of claim 1 wherein the at least one technology module includes a noise cancelling device.

13. The system of claim 1 wherein the support element includes an acoustic polymer tip secured to the distal end of the body portion, the tip being adapted to facilitate insertion of the system into the ear canal.

14. The system of claim 1 wherein the support element comprises a wire.

15. The system of claim 1 wherein the support element comprises a solid cylindrical member.

16. The system of claim 1 wherein the support element comprises a tubular member.

17. The system of claim 1 wherein the support element includes an anchoring element for securing a supplemental medical device.

18. The system of claim 17 wherein the supplemental medical device comprises a catheter.

19. The system of claim 17 wherein the supplemental medical device comprises an imaging device.

20. The system of claim 17 wherein the supplemental medical device comprises a light-generating device.

21. A technology delivery, positioning and sound management system selectively positionable at any location in the ear canal comprising:

at least one technology module;

a support element structured and arranged for insertion into the ear canal, the support element including an elongate body portion for supporting the at least one technology module and having a proximal end and a distal end;

a conformable fitting element positioned on the support element, the conformable fitting element being deformable for insertion into and removal from the ear canal and adapted to be selectively conformably fitted to the ear canal, the conformable fitting element being selectively incrementally movable between a radially compressed position and a radially expanded position, the conformable fitting element having a radial dimension in any radially expanded position which is equal to or greater than its radial dimension in the radially compressed position; and moving means for selectively incrementally moving the conformable fitting element, the moving means comprising a releasable slide mechanism.

22. A technology delivery, positioning and sound management system selectively positionable at any location in the ear canal comprising:

at least one technology module;

a support element structured and arranged for insertion into the ear canal, the support element including an elongate body portion for supporting the at least one technology module and having a proximal end and a distal end;

a conformable fitting element positioned on the support element, the conformable fitting element being deformable for insertion into and removal from the ear canal and adapted to be selectively conformably fitted to the ear canal, the conformable fitting element being selectively incrementally movable between a radially compressed position and a radially expanded position, the conformable fitting element having a radial dimension in any radially expanded position which is equal to or greater than its radial dimension in the radially compressed position; and moving means for selectively incrementally moving the conformable fitting element, the moving means comprising a releasable button-actuated mechanism.

23. A technology delivery, positioning and sound management system selectively positionable at any location in the ear canal comprising:

at least one technology module;

a support element structured and arranged for insertion into the ear canal, the support element including an elongate body portion for supporting the at least one technology module and having a proximal end and a distal end;

a conformable fitting element positioned on the support element, the conformable fitting element being deformable for insertion into and removal from the ear canal and adapted to be selectively conformably fitted to the ear canal, the conformable fitting element being selectively incrementally movable between a radially compressed position and a radially expanded position, the conformable fitting element having a radial dimension in any radially expanded position which is equal to or greater than its radial dimension in the radially compressed position; and moving means for selectively incrementally moving the conformable fitting element, the moving means comprising a variable rotating knob mechanism.

24. The system of claim 1 wherein the conformable fitting element deforms automatically in response to the shape of the ear canal upon insertion into the ear canal.

25. The system of claim 24 wherein the conformable fitting element deforms automatically from a radially expanded state to a radially compressed state upon insertion into the ear canal.

26. A technology delivery, positioning and sound management system selectively positionable at any location in the ear canal comprising:

at least one technology module;

a support element structured and arranged for insertion into the ear canal, the support element including an elongate body portion for supporting the at least one technology module and having a proximal end and a distal end; and a conformable fitting element positioned on the support element, the conformable fitting element being deformable for insertion into and removal from the ear canal and adapted to be selectively conformably fitted to the ear canal, the conformable fitting element comprising an annular braided element.

27. The system of claim 1 wherein the conformable fitting element comprises a deformable polymer material.

28. The system of claim 27 wherein the polymer material is a plastic.

29. The system of claim 1 wherein the conformable fitting element includes axially positioned structural members defining openings therebetween.

30. The system of claim 1 wherein the conformable fitting element comprises a deformable balloon.

31. The system of claim 1 wherein the conformable fitting element comprises a deformable foam member.

32. The system of claim 1 wherein the conformable fitting element comprises a laser cut material.

33. The system of claim 32 wherein the laser cut material comprises Nitinol.

34. The system of claim 1 wherein the conformable fitting element comprises a substantially porous material structured and arranged such that when conformably fitted to the ear canal, the porous material allows ambient sounds to pass directly to the ear drum.

35. The system of claim 34 wherein the porous material comprises a film layer covering the conformable fitting element, the film layer being structured and arranged to acoustically alter sound properties.

36. A system technology delivery, positioning and sound management selectively positionable at any location in the ear canal comprising:

at least one technology module;

a support element structured and arranged for insertion into the ear canal, the support element including an elongate body portion for supporting the at least one technology module and having a proximal end and a distal end; and a conformable fitting element positioned on the support element, the conformable fitting element being deformable for insertion into and removal from the ear canal and adapted to be selectively conformably fitted to the ear canal, the conformable fitting element comprising a substantially porous material structured and arranged such that when conformably fitted to the ear canal, the porous material allows ambient sounds to pass directly to the ear drum, the porous material comprising thin strands of expandable polymer structured and arranged to acoustically alter sound properties.

37. The system of claim 1 wherein the conformable fitting element comprises a substantially sound-impermeable material structured and arranged such that when conformably fitted to the ear canal, the sound-impermeable material prevents sounds from passing to the ear drum.

38. The system of claim 37 wherein the sound-impermeable material comprises a film layer covering the conformable fitting element, the film layer being structured and arranged to acoustically alter sound properties.

39. A technology delivery, positioning and sound management system selectively positionable at any location in the ear canal comprising:

at least one technology module;

a support element structured and arranged for insertion into the ear canal, the support element including an elongate body portion for supporting the at least one technology module and having a proximal end and a distal end; and a conformable fitting element positioned on the support element, the conformable fitting element being deformable for insertion into and removal from the ear canal and adapted to be selectively conformably fitted to the ear canal, the conformable fitting element comprising a substantially sound-impermeable material structured and arranged such that when conformably fitted to the ear canal, the sound-impermeable material prevents sounds from passing to the ear drum, the sound-impermeable material comprising thin strands of expandable polymer structured and arranged to acoustically alter sound properties.

40. The system of claim 17 wherein the supplemental medical device comprises a drug delivery system.

* * * * *